US005440877A

United States Patent [19]

Kamura et al.

[11] Patent Number: 5,440,877

[45] Date of Patent: Aug. 15, 1995

[54] AIR-FUEL RATIO CONTROLLER FOR AN INTERNAL COMBUSTION ENGINE

[75] Inventors: Hitoshi Kamura, Kyoto; Kazutoshi Noma, Kusatsu; Atsuyoshi Kojima, Chiryu, all of Japan

[73] Assignee: Mitsubishi Jidosha Kogyo Kabushiki Kaisha, Tokyo, Japan

[21] Appl. No.: 313,570

[22] Filed: Sep. 26, 1994

Related U.S. Application Data

[63] Continuation of Ser. No. 138,017, Oct. 19, 1993, abandoned.

[30] Foreign Application Priority Data

Oct. 20, 1992 [JP] Japan ..... 4-281357

[51] Int. Cl.[6] ..... F01N 3/20

[52] U.S. Cl. ..... 60/274; 60/276; 60/285; 123/695; 123/703

[58] Field of Search ..... 60/274, 276, 285; 123/674, 695, 703

[56] References Cited

U.S. PATENT DOCUMENTS

| | | | |
|---|---|---|---|
| 3,827,237 | 8/1974 | Linder | 60/285 |
| 4,580,539 | 4/1986 | Kitahara | 123/703 |
| 4,594,984 | 6/1986 | Raff | 123/695 |
| 4,870,938 | 10/1989 | Nakaniwa | 123/674 |
| 4,912,926 | 4/1990 | Kumagai et al. | 60/276 |
| 5,095,878 | 3/1992 | Kumagai et al. . | |
| 5,099,817 | 3/1992 | Nakaniwa | 123/674 |
| 5,154,055 | 10/1992 | Nakane | 60/276 |
| 5,220,788 | 6/1993 | Kurita | 60/276 |

*Primary Examiner*—Ira S. Lazarus
*Assistant Examiner*—Daniel J. O'Connor

[57] ABSTRACT

An alr-fuel ratio controller for-an internal-combustion engine is provided with front and rear $O_2$ sensors respectively installed in the exhaust system on the upstream and downstream sides of an exhaust gas purifier. The controller corrects the air-fuel ratio in accordance with the result of the comparison between a detected value of the front $O_2$ sensor and a first reference value, to thereby control the alr-fuel ratio to a desired value, and also corrects a value of a parameter related preferably to at least one of a correction amount or a correcting timing for the air-fuel ratio correction, e.g., the first reference value, in accordance with the deviation between a detected value of the rear $O_2$ sensor and a second reference value. When the deviation is large in magnitude, the parameter value is corrected at a larger correction degree than that used when the deviation magnitude is small, to thereby nonlinearly correct the parameter value in accordance with the magnitude of the deviation, whereby optimized correction of the parameter value is achieved so as to prevent the degeneration of the exhaust gas performance caused by the deterioration of the front and rear $O_2$ sensors or catalyst concerned.

22 Claims, 11 Drawing Sheets

AIR-FUEL RATIO CONTROLLER FOR AN INTERNAL COMBUSTION ENGINE

This application is a continuation, of application Ser. No. 08/138,017 filed on Oct. 19, 1993, now abandoned.

BACKGROUND OF THE INVENTION

The present invention relates to an air-fuel ratio controller for an internal-combustion engine, which responds to outputs from two oxygen sensors installed in an exhaust system of the engine, and more particularly, to an air-fuel ratio controller operable to carry out a proper air-fuel ratio control in response to the output of a downstream-side oxygen sensor, to thereby improve the exhaust gas performance of an internal-combustion engine.

An air-fuel ratio controller of a so-called dual $O_2$ sensor type operable to control the air-fuel ratio of an air-fuel mixture supplied to an internal combustion engine in accordance with output signals from two oxygen sensors respectively installed on the upstream and downstream sides of an exhaust gas purifier, e.g., a three way catalyst, which is disposed in an exhaust passage of the engine, is known through, e.g., Japanese Provisional Patent Publication No. 64-53043 corresponding to U.S. Pat. No. 4,912,926. In the air-fuel ratio controller of this kind, the air-fuel ratio is adjusted to be lean if an output value of the oxygen sensor (hereinafter referred to as a "front $O_2$ sensor) provided on the upstream side of the three way catalyst is greater than a first reference discriminant value, while the air-fuel ratio is adjusted to be rich when the output value of the front $O_2$ sensor is smaller than the first reference discriminant value. In addition, the first reference discriminant value is feedback-corrected to a value which, for instance, allows an optimum exhaust gas characteristic to be achieved, in accordance with the deviation of the output value of the oxygen sensor (called a "rear $O_2$ sensor") installed on the downstream side of the three way catalyst from a second reference discriminant value.

In addition to the aforesaid method of feedback controlling the first reference discriminant value to an optimum value in accordance with the deviation of the rear $O_2$ sensor output from the second reference discriminant value, a method is known in which the integral gain or proportional gain in the air-fuel ratio control carried out based on the output signal value of the front $O_2$ sensor is feedback-corrected to an optimum value In accordance with the deviation of the output value of the rear $O_2$ sensor from the second reference discriminant value. It is also well known that, in the similar air-fuel ratio control, the period from the moment the output value of the front $O_2$ sensor crosses the first reference discriminant value to the moment when the air-fuel ratio is corrected (i.e., the delay period of the air-fuel ratio correction implementing timing) is positively feedback-corrected according to the deviation between the rear $O_2$ sensor and the second reference discriminant value, thereby improving the exhaust gas characteristics.

When a parameter such as the first reference discriminant value, integral gain, proportional gain or delay period is corrected in accordance with the deviation between the rear $O_2$ sensor and the second reference discriminant value-as described above, a correction amount of the parameter is conventionally set to a value which is equal to the product of the deviation and a constant correction gain, and hence which is proportional to the magnitude of the deviation. In other words, a correction gain, which takes a constant value regardless of the magnitude of the deviation, is used for setting the amount of correction.

However, if the constant correction gain is set to a small value, then the parameter correction amount equal to the product of the magnitude of the deviation and the correction gain value will also take a small value. Therefore, if a significant deviation occurs between the rear $O_2$ sensor and the second reference discriminant value, then a parameter correction, which is adequate for eliminating the significant deviation, may not be performed. On the other hand, If the correction gain is set to a large value, a significant deviation may cause over-correction of the parameter due to a delayed response of the rear $O_2$ sensor. Thus, if an excessive or inadequate parameter correction is made, then the degeneration of the exhaust gas performance caused by the deterioration of the $O_2$ sensor or the catalyst cannot be adequately prevented.

OBJECT AND SUMMARY OF THE INVENTION

An object of the present invention is to provide an air-fuel ratio controller for an internal-combustion engine, which controller is operable to optimize the degree of correction in correcting a parameter related preferably to air-fuel ratio correction wherein the air-fuel ratio is effected in accordance with an output from an oxygen sensor disposed at a downstream side of an exhaust gas purifier, to thereby prevent the degeneration of the exhaust gas performance of the engine due to the deterioration of the oxygen sensor or catalyst concerned.

According to the present invention, an air-fuel ratio controller for an internal-combustion engine is provided, comprising: an upstream-side oxygen sensor, installed in an exhaust system of the internal-combustion engine on an upstream side of an exhaust gas purifier, for detecting a first oxygen concentration in exhaust gas; a downstream-side oxygen sensor, installed in the exhaust system on a downstream side of or inside the exhaust gas purifier, for detecting a second oxygen concentration in exhaust gas; air-fuel ratio control means for correcting an air-fuel ratio of an air-fuel mixture supplied to the internal-combustion engine in accordance with a result of comparison between the first oxygen concentration value detected by the upstream-side oxygen sensor and a first reference value, to thereby control the air-fuel ratio to a desired value; and parameter value correcting means for correcting a value of a parameter, related to operation of the air-fuel ratio control means, in accordance with a difference between the second oxygen concentration value detected by the downstream-side oxygen sensor and a second reference value. The parameter value correcting means corrects the value of the parameter at a correction degree that changes according to a magnitude of the difference between the detected value of the second oxygen concentration and the second reference value.

Preferably, the parameter is related to the air-fuel ratio correction carried out by the air-fuel ratio control means. More preferably, the parameter is related to at least one of a correction amount and a correction implementing timing in the air-fuel ratio correction.

Preferably, when the difference is large, the parameter value correcting means corrects the parameter value at a larger correction degree than that used when the difference is small.

Preferably, the parameter value correcting means corrects the first reference value which serves as the parameter.

Preferably, the air-fuel ratio control means executes integral or proportional correction control for the air-fuel ratio control by using a correction factor which includes an integral or proportional correction term, and corrects a value of the integral or proportional correction term in accordance with the result of the comparison between the first oxygen concentration value and the first reference value. The parameter value correcting means corrects the integral or proportional correction term which functions as the parameter.

Preferably, the air-fuel ratio control means corrects the air-fuel ratio at the moment when a desired delay time has elapsed since the first oxygen concentration value, which is detected by the upstream-side oxygen sensor, crossed the first reference value. The parameter value correcting means corrects the delay time which functions as the parameter.

Preferably, when a magnitude of the difference is greater than a predetermined magnitude, the parameter value correcting means corrects the parameter value by a limited amount of correction. When a magnitude of the difference is smaller than a predetermined magnitude, the parameter value correcting means does not effect any substantial correction to the parameter value.

Preferably, the parameter value correcting means smooths a value of the second oxygen concentration detected by the downstream-side oxygen sensor, and corrects the parameter value in accordance with the difference between the smoothed value obtained and the second reference value.

The air-fuel ratio controller according to the present invention is advantageous in that the value of the parameter, related to operation of the alr-fuel ratio control means, can be nonlinearly corrected with respect to the deviation between the exhaust gas oxygen concentration detected by the downstream-side oxygen sensor and the second reference value. This makes it possible to perform fine and accurate correction of the parameter value in a small correction degree when the deviation is small in magnitude, while it is possible to effect the correction of the parameter value in a large correction degree with good responsiveness when the deviation is large In magnitude. Accordingly, the degeneration of the exhaust gas performance due to the deterioration of the oxygen sensor or exhaust gas purifier concerned can be prevented.

BRIEF DESCRIPTION OF THE DRAWING

The present invention will become more fully understood from the detailed description given herein below and the accompanying drawings which are given by way of illustration only, and thus are not limitative of the present invention, and wherein.

DETAILED DESCRIPTION FOR THE PREFERRED EMBODIMENTS OF THE PRESENT INVENTION

An air-fuel ratio controller for an internal-combustion engine according to an embodiment of the present invention will now be explained in detail with reference to the drawings.

Figure 1:
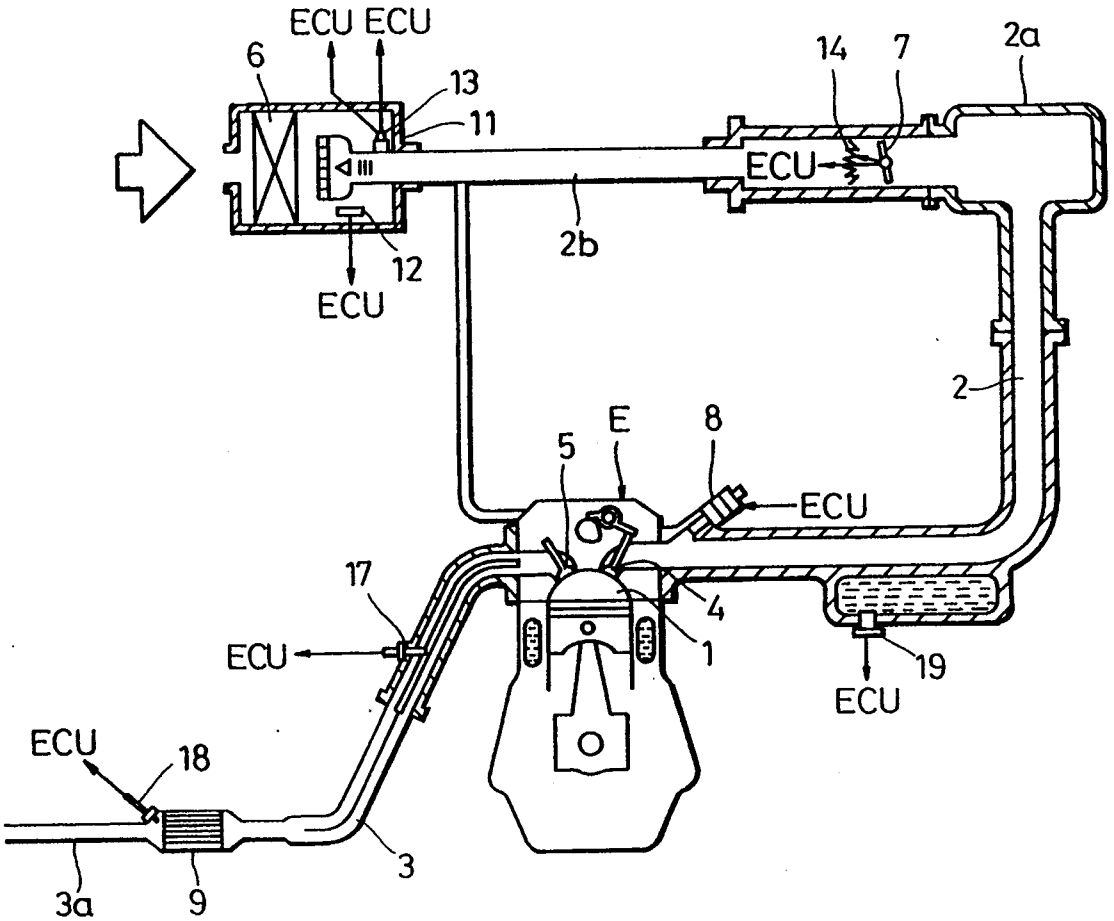
FIG. 1 is a schematic diagram showing part of an air-fuel ratio controller according to an embodiment of the present invention, together with its peripheral elements.

In FIG. 1, a symbol E denotes, for example, a 4-cylinder engine (hereinafter referred to simply as "engine"). The engine E is operable under the control of an air-fuel ratio controller for carrying out an air-fuel ratio control method of a dual $O_2$ sensor type. The engine E has an inlet manifold 2 communicated to combustion chambers 1 of respective cylinders via inlet valves 4, and an exhaust manifold 3 communicated to the combustion chambers 1 via exhaust valves 5. The inlet manifold 2 is provided with electromagnetic fuel injection valves 8 disposed at locations adjacent to inlet ports. One end of an inlet pipe **2*b* is connected to the inlet manifold 2 via a surge tank 2*a*, and the other end (opened to atmospheric air) of the inlet pipe 2*b* is provided with an air cleaner 6. Further, a throttle valve 7 is provided in the middle of the inlet pipe 2*b*. Fuel is supplied to the fuel injection valves 8** from a fuel pump, not shown, with the fuel pressure adjusted to a constant level by a fuel pressure regulator.

The exhaust manifold 3 has an atmospheric air side-end thereof connected to a collecting exhaust pipe **3*a*. In the middle of the collecting exhaust pipe 3*a*, a catalyst converter (exhaust gas purifier) 9 of a three way catalyst type is provided. On the upstream side of the catalyst converter 9, the exhaust manifold 3 is provided with an oxygen sensor (hereinafter referred to as "front $O_2$ sensor") 17 for detecting an amount of oxygen in the exhaust gas. On the downstream side of the catalyst converter 9, the collecting exhaust pipe 3*a* is provided with an oxygen sensor (hereinafter referred to as "rear $O_2$ sensor") 18 for detecting an amount of remaining oxygen in the exhaust gas after passing through the catalyst converter 9. These front and rear $O_2$ sensors 17 and 18 are provided with heaters for maintaining their detector section at a high temperature. The sensors 17 and 18 are electrically connected to the input side of an electronic control unit (ECU) 40, so as to supply oxygen concentration detection signals to the ECU 40. The rear $O_2$ sensor 18 may alternatively be installed at a location downstream of a converter section in the exhaust gas purifier 9**.

As described later in detail, the electronic control unit 40 is operable to calculate an amount of fuel to be injected, that is, a valve opening duration $T_{INJ}$ of each fuel injection valve 8 suited to an engine operating condition according to the detection signals of the aforementioned sensors, and supply a driving signal, corresponding to the calculated valve opening duration $T_{INJ}$, to the associated fuel Injection valve 8, to thereby open the Injection valve, so that a desired amount of fuel is injected and supplied to each cylinder.

Figure 2:
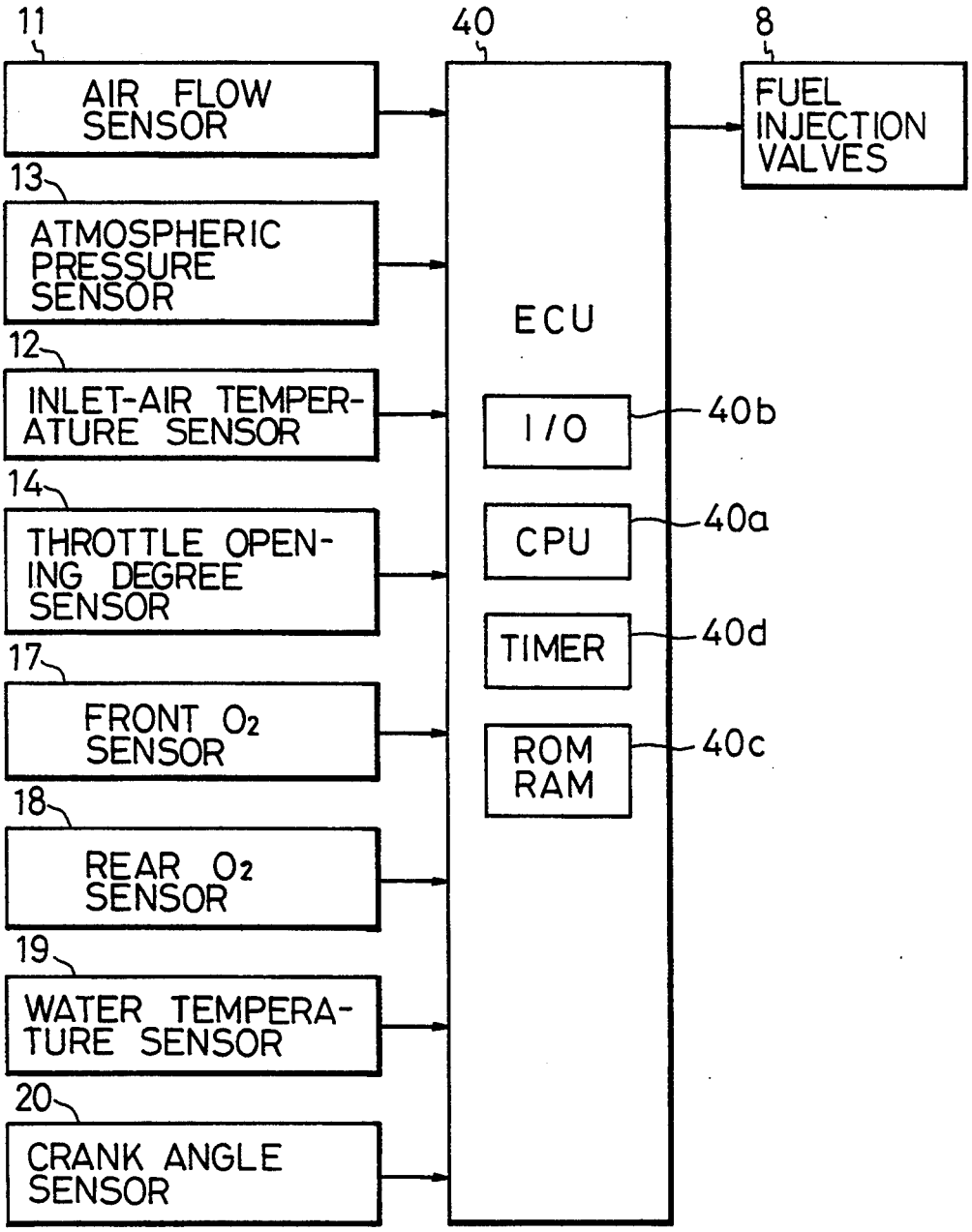
FIG. 2 is a block diagram showing the internal configuration of an electronic controller serving as a principal part of the air-fuel ratio controller which is partially shown in FIG. 1.

As shown in FIG. 2, the electronic control unit 40 mainly consists of a central processing unit (CPU) 40*a* for executing the calculation of fuel injection amounts; an interface unit (I/O) 40*b* for performing amplification, filtering, A/D conversion, etc. of the detection signals read from the sensors and for supplying the driving signals, which correspond to the results of calculation performed by the CPU 40*a*, to the fuel injection valves 8; a memory 40*c* which includes a ROM for storing therein arithmetic programs including an arithmetic procedure for fuel injection amounts, various program variable values, coefficient values, etc., and a RAM for temporarily storing various data; and a counter (timer) 40d for counting various time periods.

The fuel injection valves 8, which are electrically connected to the output side of the electronic control unit 40, are operated to be opened by the driving signals received from the electronic control unit 40, to thereby inject and supply a desired amount of fuel to the individual cylinders, as discussed in detail later.

In addition to the front and rear $O_2$ sensors 17 and 18, various sensors for detecting the operating condition of the engine E are connected to the input side of the electronic control unit 40, and the outputs from these sensors are supplied to the electronic control unit 40. In FIG. 2, reference numeral 11 denotes an air flow sensor installed in the vicinity of one end (opened to the air) of the inlet pipe 2*a* for detecting the Karman's vortex street and generating pulses at a frequency proportional to the intake air volume; 12, denotes an inlet-air temperature sensor installed in the air cleaner 6 for detecting the intake-air temperature; 13, denotes an atmospheric pressure sensor for detecting the atmospheric pressure; and 14, denotes a throttle opening sensor for detecting the valve opening degree of the throttle valve 7. Further, reference numeral 19 represents a water temperature sensor for detecting the temperature of the cooling water of the engine E, and 20 represents a crank angle sensor installed on a distributor, not shown, for generating a crank pulse signal (TDC signal) each time the crank angle sensor 20 detects a predetermined crank angle position, e.g., the upper dead center or a position slightly short of the upper deadcenter. Although illustration is omitted, further connected to the input side of the electronic control unit 40 are a cylinder discriminating sensor installed on the distributor for detecting that a predetermined crank angle position (e.g., the compression upper dead center or a position slightly short of the compression upper dead center) is reached in a particular cylinder (e.g., a first cylinder), an idle switch for detecting the fully closed position of the throttle valve 7, an air conditioner switch for detecting the operating condition of an air conditioner, a battery sensor for detecting the battery voltage, etc.

The crank angle sensor 20 generates the TDC signal for each 180-degree crank angle, enabling the electronic control unit 40 to detect an engine speed Ne from the pulse generating intervals of the TDC signal. The electronic control unit 40, in which the igniting sequence of the cylinders, that is, the sequence of supplying the fuel to the individual cylinders is stored beforehand, is enabled to determine to which cylinder it should inject and supply the fuel next, as the cylinder discriminating sensor detects that the predetermined crank angle position is reached in the particular cylinder.

The above-mentioned computing procedure of the valve opening duration $T_{INJ}$ executed by the electronic control unit 40 will now be described with reference to the drawings.

Air-fuel ratio control

Figure 3:
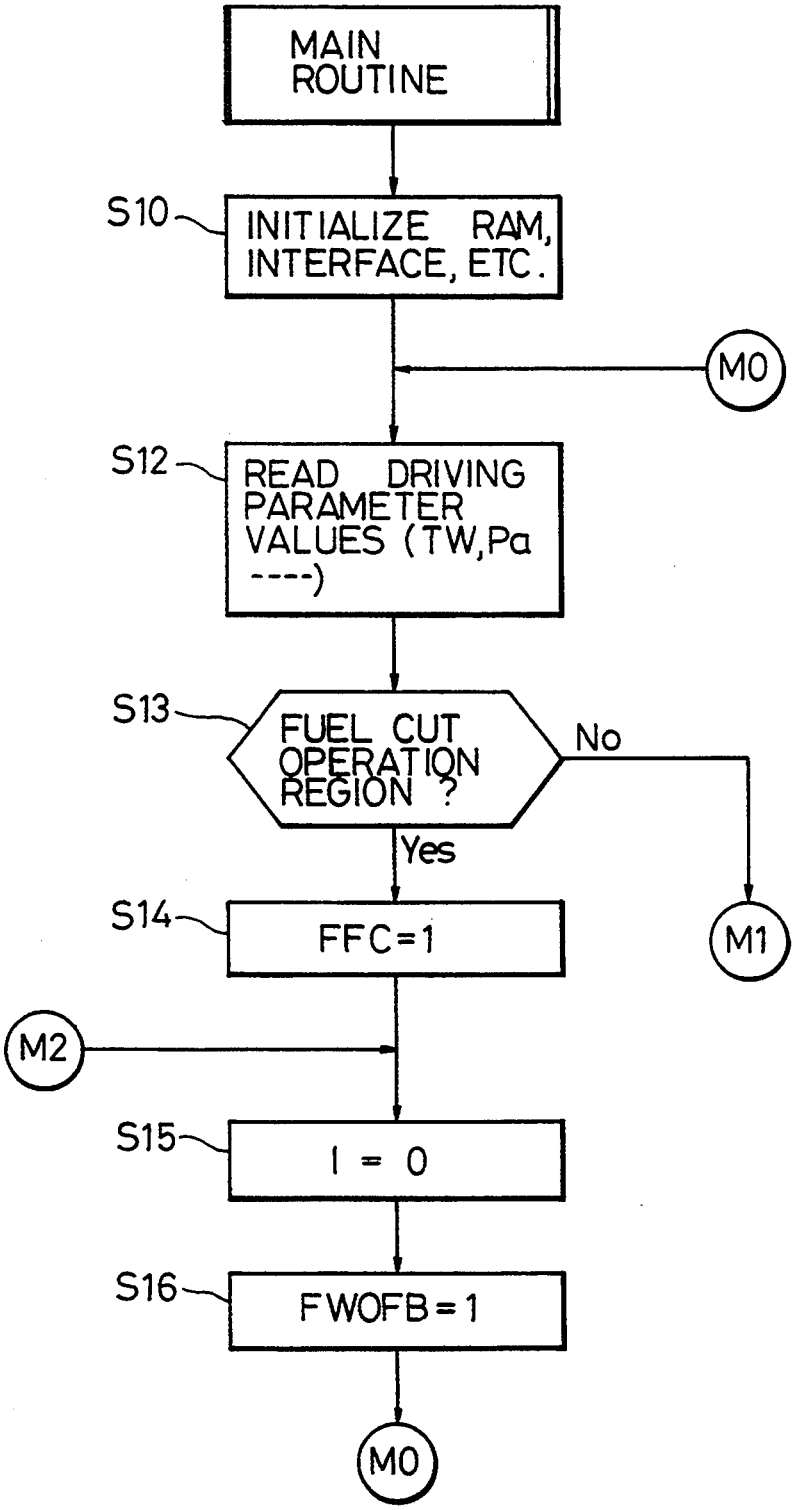
FIG. 3 is a flowchart showing part of a main routine executed by the electronic controller shown in FIG. 2.
Figure 4:
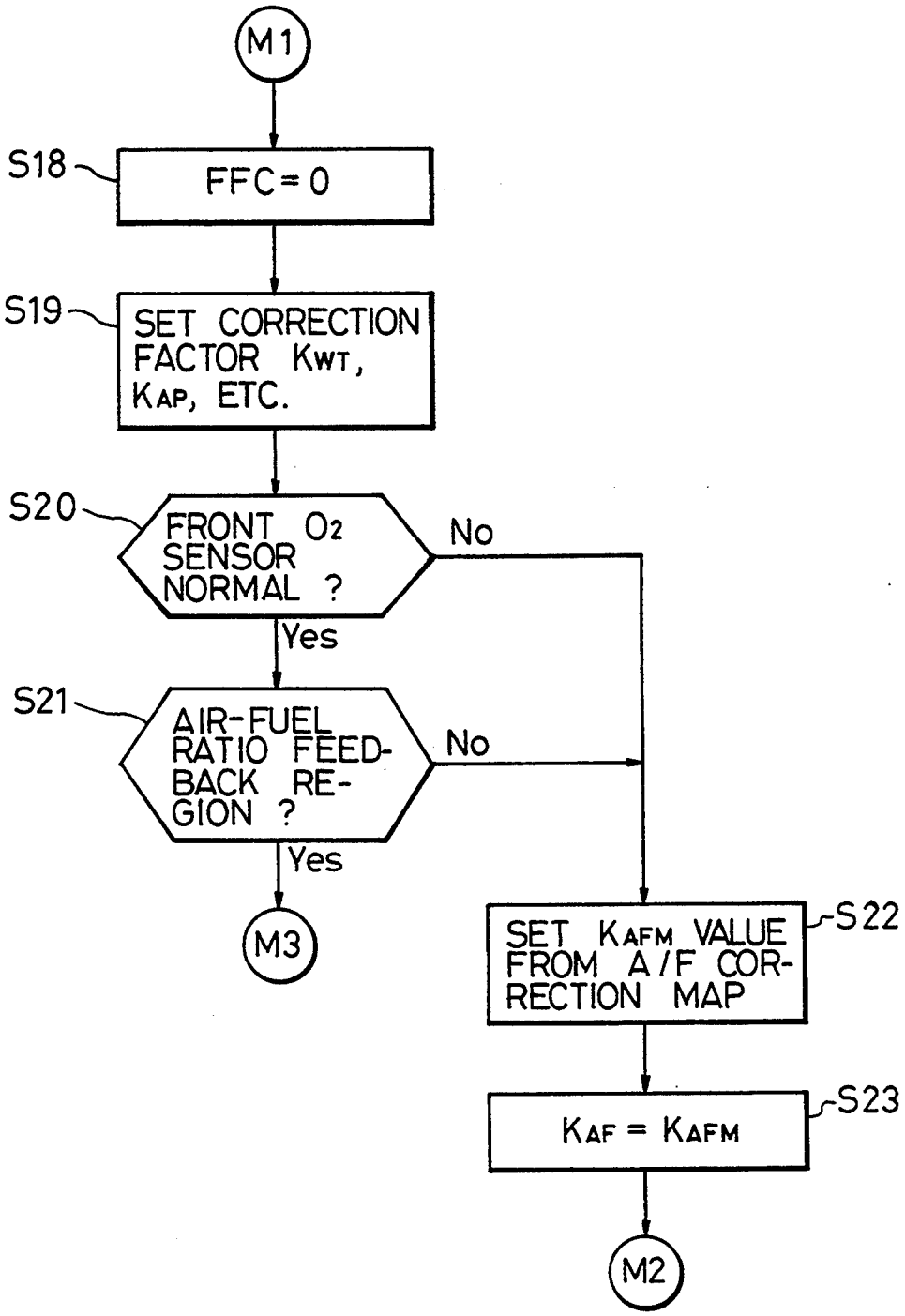
FIG. 4 is a flowchart showing another part of the main routine, which continues from the flowchart shown in FIG. 3.
Figure 5:
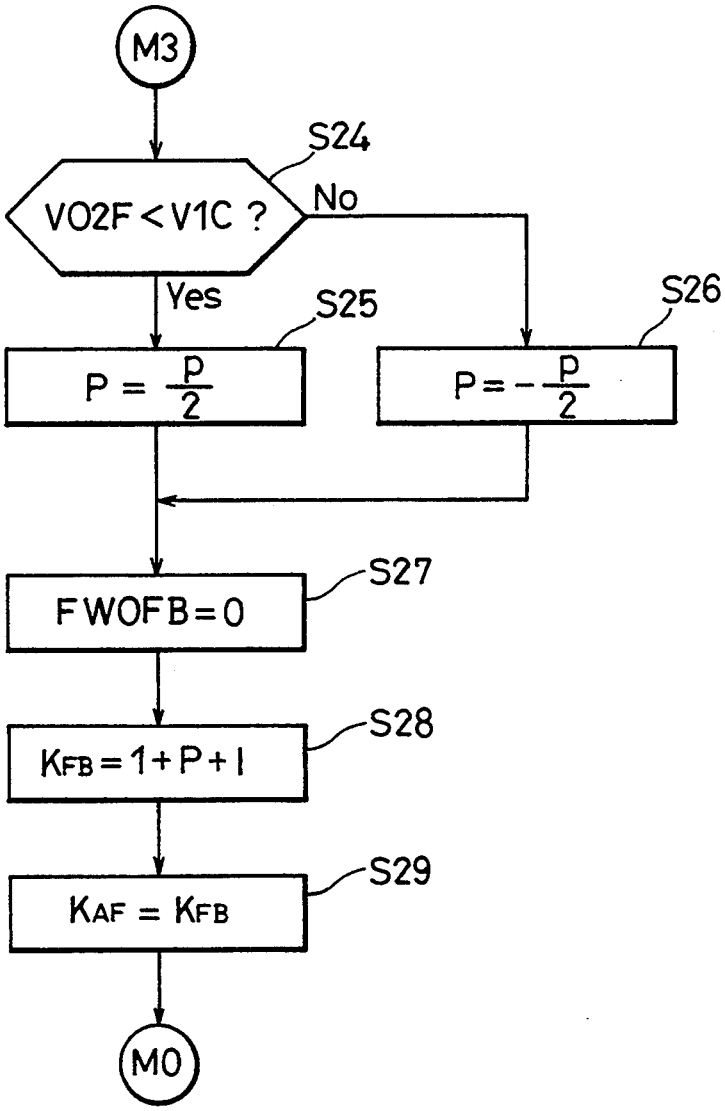
FIG. 5 is a flowchart showing the remainder of the main routine, which continues from the flowchart shown in FIG. 4.
Figure 6:
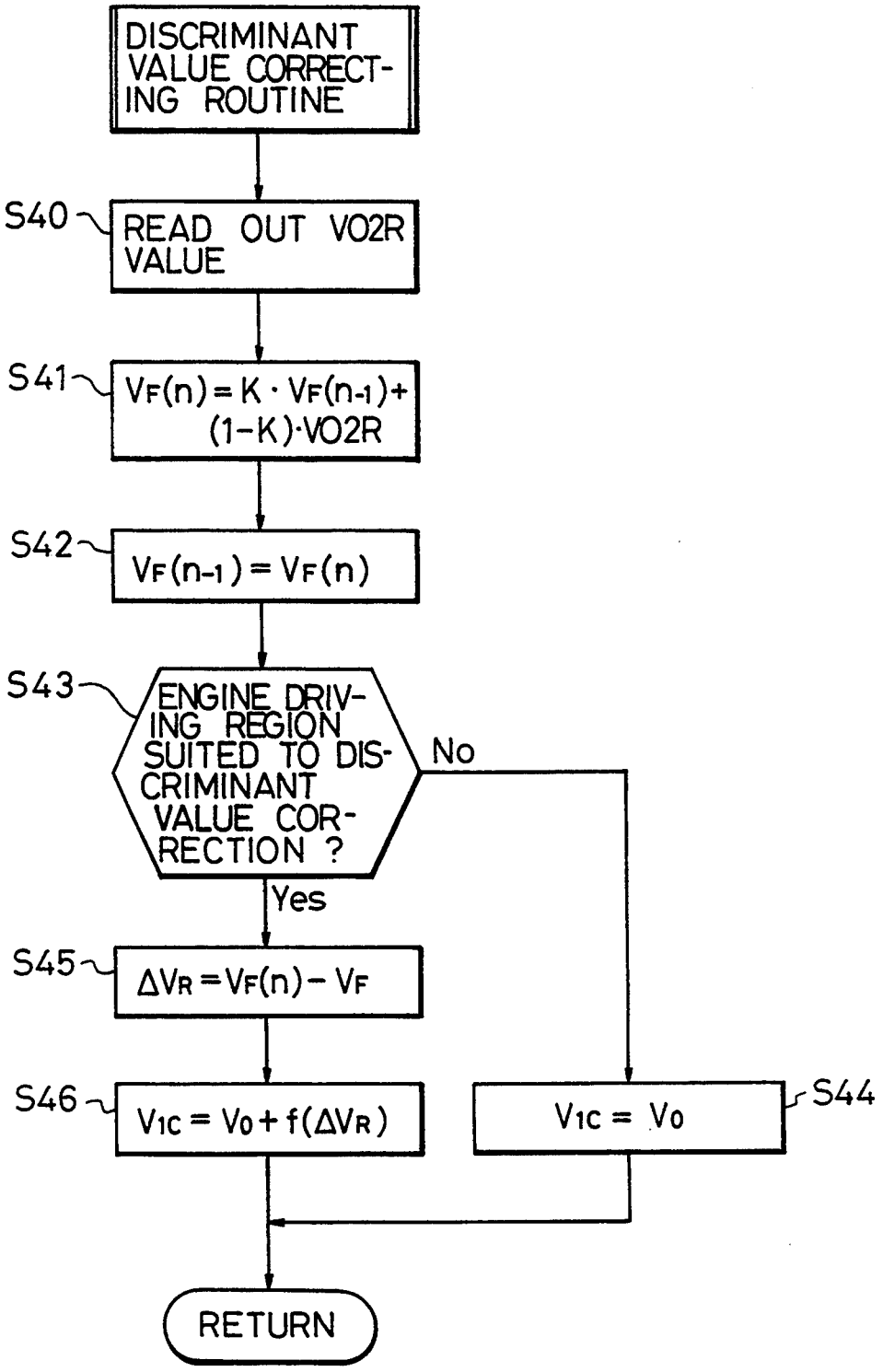
FIG. 6 is a flowchart of a discriminant value correcting routine which is implemented by the electronic controller.
Figure 10:
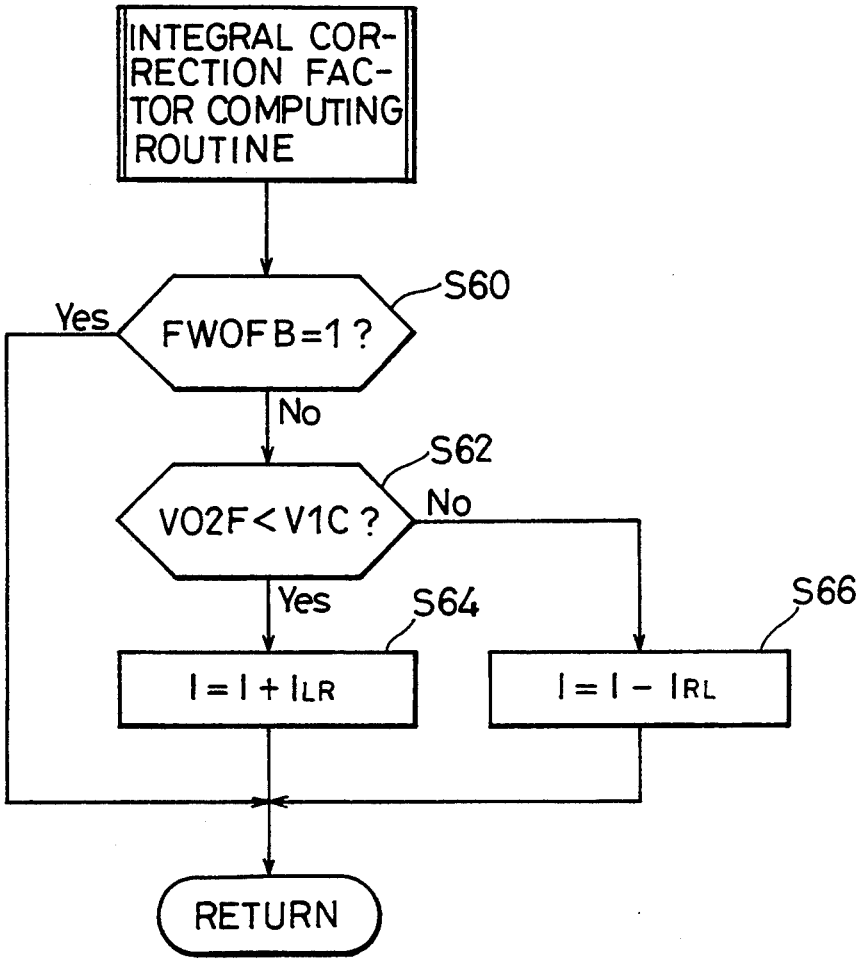
FIG. 10 is a flowchart of an integral correction factor computing routine which is implemented by the electronic controller.
Figure 11:
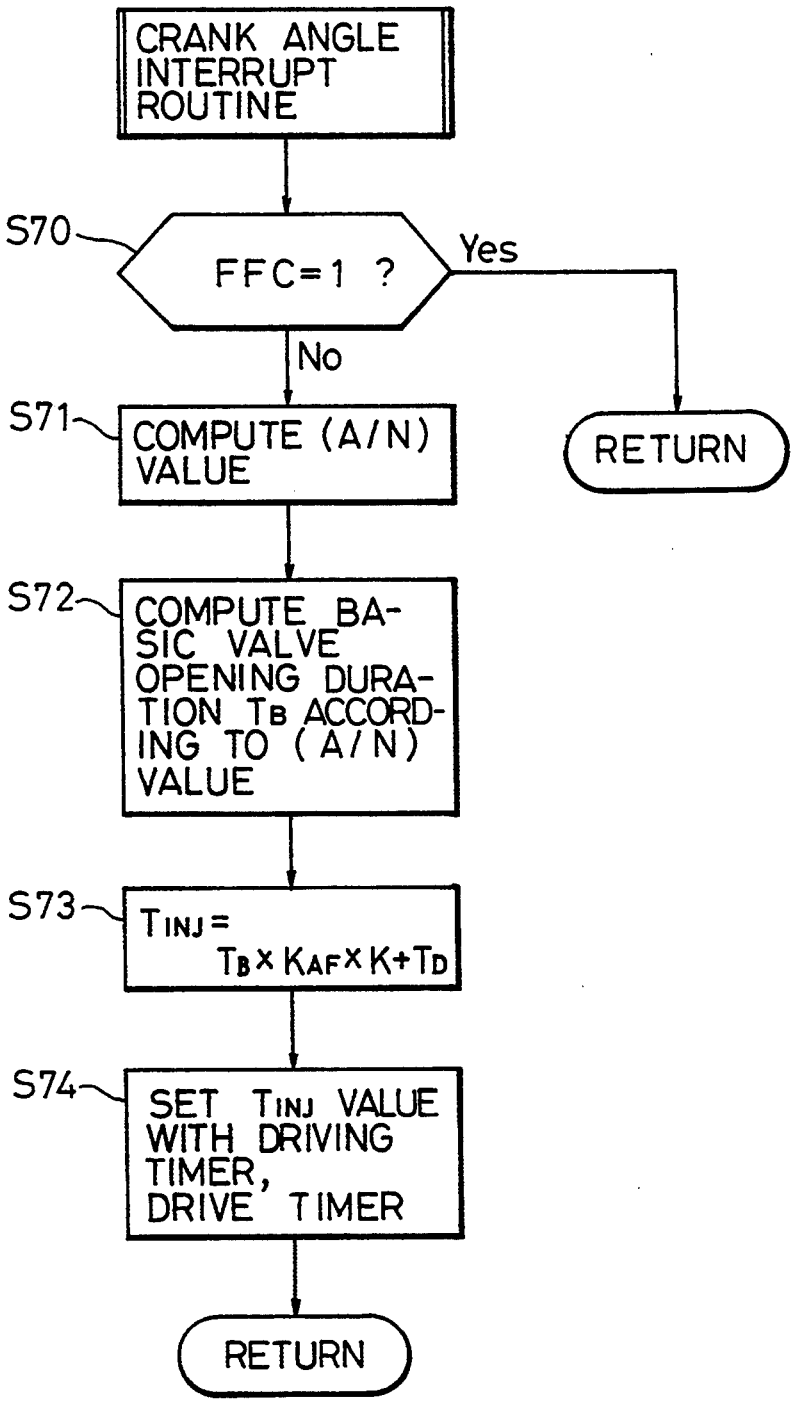
FIG. 11 is a flowchart of a crank angle interruption routine implemented by the electronic controller.

To compute the valve opening duration $T_{INJ}$ and cause the fuel injection valves 8 to inject fuel, the electronic control unit 40 executes a main routine shown in FIGS. 3–5 for computing fuel supply amount correction factors, a discriminant value correction routine shown in FIG. 6 for feedback-correcting a discriminant value $V_{1C}$, related to the front $O_2$ sensor 17 and used in the main routine, in accordance with an output value of the rear $O_2$ sensor 18, an integral correction factor computing routine shown in FIG. 10 for computing an integral correction term I used in the main routine for computing the feedback correction factor $K_{FB}$, and a crank angle interruption routine shown in FIG. 11 for computing the valve opening duration $T_{INJ}$ with use of the correction factor values obtained in the main routine and for delivering driving signals to the fuel injection valves 8.

Arithmetic processing for the correction factors

First, the main routine shown in FIGS. 3–5 will be described. The electronic control unit 40 initializes the RAM, the I/O interface, etc. in a step S10 only once when an ignition switch is turned ON, and after that, the ECU 40 repeatedly implements a step S12 and subsequent steps of the main routine except when the ECU 40 encounters with an interruption request for execution of another routine.

In the step S12, the electronic control unit 40 reads the aforesaid detection signals of the sensors in sequence, and conducts input information processing such as A/D conversion. The sensor inputs to be subjected to the input information processing in the step S12 include the engine cooling water temperature Tw detected by the water temperature sensor 19, the intake air temperature Ta detected by the intake air temperature sensor 12, the atmospheric pressure Pa detected by the atmospheric pressure sensor 13, the oxygen concentration output values $V_{02F}$ and $V_{02R}$ respectively detected by the front $O_2$ sensor 17 and the rear $O_2$ sensor 18, etc. The detected values, which have undergone the input information processing, are stored in the memory 40*c* incorporated in the electronic control unit 40.

The electronic control unit 40 then determines in a step S13 whether the engine E is being driven in a predetermined fuel supply stop operation region (fuel cut operation region). In this operation region, the engine E is in a deceleration state, and under such a condition, no fuel is supplied to the engine E. If the judgment result of the step S13 is affirmative (Yes), then the program goes to a step S14 wherein the control unit 40 sets a fuel cut flag FFC to a value of "1" to thereby store that the engine E is being driven in the fuel cut operation region. The electronic control unit then implements steps S15 and S16 to set the integral term value I, used for computing a feedback correction factor value $K_{FB}$, to a value "0," and also set a flag FWOFB to a value "1" indicating that the air-fuel ratio is not being feedback-controlled. Then, the program returns from an entry point MO to the step S12. On the other hand, if the judgment result obtained in the step S13 is negative (No), then the program proceeds to a step S18 of FIG. 4 in which the control unit resets the fuel cut flag FFC to the value "0," to thereby store that the engine E is not being operated in the fuel cut operation region. In a step S19, the electronic control unit 40 will then set the correction factor values except an air-fuel ratio correction factor $K_{AF}$. These correction factor values primarily include, for instance, a water temperature correction factor $K_{WT}$ which is set in accordance with the engine cooling water temperature Tw, an Intake air temperature correction factor $K_{AT}$ which is set in accordance with the intake air temperature Ta, an atmospheric pressure correction factor $K_{AP}$ which is set in accordance with the atmospheric pressure Pa, and a dead time correction value $T_D$ which is set in accordance with the battery voltage.

In the subsequent steps S20 and S21, the electronic control unit 40 decides whether the ECU 40 should subject the air-fuel ratio to the feedback control or open-loop control. First, in the step S20, the electronic control unit 40 determines whether the front $O_2$ sensor 17 is working normally. This determining process includes the Judgment of whether the front $O_2$ sensor 17 is in an active state, and the judgment of the presence of a failure such as disconnection. In the failure judgment, the control unit determines whether a state, wherein the output voltage of the front $O_2$ sensor 17 is at OV or at a predetermined voltage (e.g., 5V) or higher, has continued for a predetermined duration. On the other hand, in the active state judgment, the electronic control unit 40 determines that the front $O_2$ sensor 17 has switched to an active state when, for instance, the front $O_2$ sensor 17 output voltage has risen to the reference voltage $V_{1C}$ or higher for the first time after the engine was started, while the ECU 40 determines that the front $O_2$ sensor has been in an inactive state when the front $O_2$ sensor output voltage has not crossed the reference voltage $V_{1C}$ for a predetermined duration (e.g., 20 sec.) during the air-fuel ratio feedback control. If the front $O_2$ sensor 17 is not working properly (if the judgment result in the step S20 is negative), then the air-fuel ratio is subjected to the open-loop control, as discussed later.

If the judgment result in the step S20 is affirmative, then the electronic control unit 40 decides whether the engine E is being driven in the predetermined air-fuel ratio feedback control region (step S21). This Judgment is performed based on, for example, the engine speed Ne and the intake air amount A/N. The electronic control unit 40 decides that the engine E is not being driven in the air-fuel ratio feedback control region, if the engine is being driven in the wide-open throttle operation region wherein the throttle valve 7 is fully opened, the acceleration operation region wherein the throttle valve 7 has been rapidly opened, or the deceleration operation region wherein the engine speed Ne is the predetermined speed or higher and the idle switch is ON. The electronic control unit 40 waits until the intake air amount reaches the predetermined value or more even if the engine E enters into the air-fuel ratio feedback control region. Immediately after the fuel cut operation, the electronic control unit 40 also determines whether the intake air amount is the predetermined value or more. If the intake air amount is below the predetermined value, then the electronic control unit 40 inhibits the air-fuel ratio feedback control.

To perform the air-fuel ratio control in the feedback control mode, the program proceeds to a step S24 of FIG. 5 wherein the electronic control unit 40 determines whether the output value $V_{02F}$ of the front $O_2$ sensor 17 is a value on the lean fuel side with respect to the first reference discriminant value $V_{1C}$ ($V_{02F}<V_{1C}$). If the Judgment result is affirmative, then the electronic control unit 40 sets a value "p/2" as a proportional correction value P which is used for computing the feedback correction factor $K_{FB}$ (step S25), while the electronic control unit 40 sets a value "-p/2" if the judgment result is negative (step S26). The electronic control unit 40 then resets the feedback control release flag FWOFB to the value "0" in the step S27, and proceeds to a step S28 wherein ECU 40 computes the feedback correction factor value $K_{FB}$ according to the following formula (M1):

$$K_{FB}=1.0+P+I, \quad \text{(M1)}$$

where "I" is the integral correction value (integral correction factor) which is computed by the integral correction factor computing routine to be discussed later.

FIG. 10 shows the integral correction factor computing routine for setting the integral correction value I. The routine is interrupt-executed at intervals of a predetermined cycle; the routine may alternatively be interrupt-executed each time the predetermined crank angle position is detected by the crank angle sensor 20. The electronic control unit 40 first determines in a step S60 whether the flag FWOFB has been set to the value "1." If the flag value is "1," it means that the air-fuel ratio is not being feedback-controlled. In this case, the electronic control unit 40 terminates the routine, without computing the integral correction value.

If, on the other hand, the flag FWOFB has not been set to the value "1," then the program proceeds to a step S62 wherein the electronic control unit 40 judges whether the output value $V_{02F}$ of the front $O_2$ sensor 17 is smaller than the discriminant value $V_{1C}$. If the judgment result is affirmative, the electronic control unit 40 adds a predetermined value $I_{LR}$, which is a rich integral correction factor, to the integral correction value I stored in the memory 40c, to thereby make the air-fuel ratio rich. The electronic control unit 40 stores this value as the updated integral correction value I($=I+I_{LR}$) (step S64). As long as the state wherein the output value $V_{02F}$ is smaller than the discriminant value $V_{1C}$ continues, the step S64 is repeatedly implemented, causing the integral correction value I to gradually grow to a greater value. Therefore, as long as the rich integral correction factor value $I_{LR}$ is added, the feedback correction factor value $K_{FB}$ continues to increase, causing the air-fuel ratio to grow richer. On the other hand, if the output value $V_{02}$ of the front $O_2$ sensor 17 is not smaller than the discriminant value $V_{1C}$, then the electronic control unit 40 deducts a predetermined value $I_{RL}$, which is a lean integral correction factor, from the integral correction value I stored in the memory 40c, to thereby make the airfuel ratio lean. The electronic control unit 40 stores this value as the updated integral correction value $I(=I-I_{RL})$ (step S66). If the state wherein the output value $V_{02F}$ is larger than the discriminant value $V_{1C}$ continues, then the step S66 is repeatedly implemented, causing the integral correction value I to gradually decrease to a smaller value. Therefore, as long as the lean integral correction factor value $I_{RL}$ is deducted, the feedback correction factor value $K_{FB}$ continues to decrease, causing the air-fuel ratio to become leaner.

Referring to FIG. 5 again, the feedback correction factor value $K_{FB}$ computed in the step S28 is stored as the air-fuel ratio correction factor $K_{AF}$ (step S29), and the program goes back to the step S12 again.

On the other hand, if the judgment result of the step S20 or S21 of FIG. 4 is negative, and the electronic control unit 40 accordingly needs to carry out the air-fuel ratio control in the open-loop control mode, the program proceeds to a step S22 wherein the electronic control unit 40 reads a correction value $K_{AFM}$ suited to the engine load (the opening degree of the throttle valve) and the engine speed Ne from an air-fuel ratio (A/F) correction map (not shown) which is stored in the memory 40c. The conventional 4-point interpolation method or the like may be applied to the reading. The program then advances to a step S23 wherein the electronic control unit 40 sets the correction value $K_{AFM}$, which has been read in the step S22, as the air-fuel ratio correction factor value After setting the air-fuel ratio correction factor value $K_{AF}$ in such a way, the electronic control unit 40 executes the steps S15 and S16 to set the integral term value I of the feedback correction factor value $K_{FB}$ to the value "0," and the flag FWOFB to the value "1" before it returns to the step S12.

Feedback correction of the discriminant value $V_{1C}$

FIG. 6 shows a procedure for feedback-correcting the discriminant value $V_{1C}$, which is used for judging the output of the front $O_2$ sensor 17 in the step S24 of the main routine, according to the output value of the rear $O_2$ sensor 18. The routine is repeatedly executed by the electronic control unit 40 at intervals of a predetermined cycle (e.g., at a 25 msec. cycle).

The electronic control unit 40 first reads the output value $V_{02R}$ of the rear $O_2$ sensor 18 (step S40). The output value $V_{02R}$ is generated by subjecting the output voltage of the rear $O_2$ sensor 18 to signal processing beforehand in the I/O interface unit 40b. Then, the output value $V_{02R}$, which has been read, is subjected to filtering in accordance with the following formula (B1) (step S41), whereby the output $V_{02R}$ of the rear $O_2$ sensor 18 is smoothed.

$$V_{F(n)}=K\times V_{F(n-1)}+(1-K)\times V_{02R}, \quad \text{(B1)}$$

where K is a weight factor which is smaller than the value "1," and $V_{F(n-1)}$ is the previously computed value. Upon completion of the computation based on the above formula, the previously computed value $V_{F(n-1)}$, which is stored in the memory 40c, is updated to the new computed value $V_{F(n)}$ (step S42) for the subsequent computation.

The electronic control unit 40 then determines whether the engine E is being driven in a predetermined driving region suited for executing the correction of the discriminant value $V_{1C}$ based on the output value of the rear $O_2$ sensor 18 (step S43). If the judgment result is affirmative, then the electronic control unit 40 computes the deviation $\Delta V_R(=V_{F(n)}-V_F)$ between the computed output value $V_{F(n)}$ and a first predetermined reference value $V_F$ (step S45), and corrects the reference discriminant value $V_{1C}$ in accordance with the thus computed deviation $\Delta V_R$ (step S46).

Figure 7:
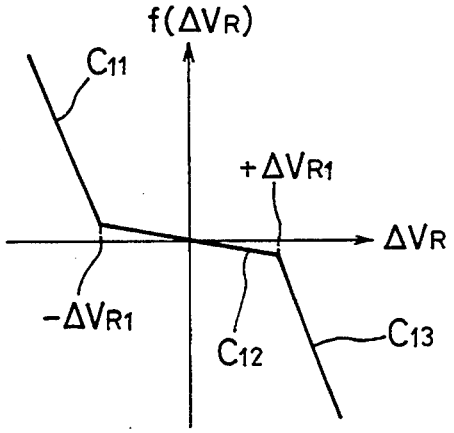
FIG. 7 is a graph showing an example of a a $\Delta V_R$-$f(\Delta V_r)$ curve used for setting a correction value $f(\Delta V_R)$ in accordance with a deviation a $\Delta V_{1R}$ between the output of the rear $O_2$ sensor and a reference value.

FIG. 7 shows a deviation-correction value curve for setting a correction value $f(\Delta V_R)$ used for correction of the reference discriminant value $V_{1C}$. The deviation-correction value curve consists of first, second, and third straight lines $C_{11}$, $C_{12}$, and $C_{13}$ which correspond to the three deviation regions, respectively. The first straight line $C_{11}$, which corresponds to the region where the deviation $\Delta V_R$ takes a value which is smaller than the value $-\Delta V_{R1}$, gives the correction value $f(\Delta V_R)$ which decreases at a large degree as the deviation $\Delta V_R$ increases. The second straight line $C_{12}$, which corresponds to a region where the deviation a $V_R$ takes a value which is equal to or greater than the value $-\Delta V_{R1}$ and which is equal to or smaller than the value $\Delta V_{R1}$, gives the correction value $f(\Delta V_R)$ which decreases at a small degree as the deviation $\Delta V_R$ increases. The third straight line $C_{13}$, which corresponds to a region where the deviation $\Delta V_R$ takes a value which is larger than the value a $V_{R1}$, gives the correction value $f(\Delta V_R)$ which decreases at a large degree as the deviation $\Delta V_R$ increases.

To set the correction value $f(\Delta V_R)$ in accordance with the deviation-correction value curve, the electronic control unit 40 sets the correction value $f(\Delta V_R)$, which corresponds to the magnitude and sign of the deviation $\Delta V_R$ determined in the step S45, referring to the deviation-correction curve. In other words, the correction value $f(\Delta V_R)$ is set In accordance with the magnitude and sign of the deviation a $V_R$ and the correction gain (slope of the deviation-correction curve) which matches the magnitude of the deviation. More specifically, unlike the conventional method which always uses a constant correction gain regardless of the magnitude of the deviation $\Delta V_R$, the method according to an embodiment of the present invention sets the correction value $f(\Delta V_R)$, which serves as the parameter value (more specifically, air-fuel ratio control parameter value), with a small correction gain when the magnitude of the deviation $\Delta V_R$ is small, so that the reference discriminant value $V_{1C}$ is finely and accurately corrected using the correction value at a small correction degree, while the correction value is set with a large correction gain when the magnitude of the deviation $\Delta V_R$ is large, so that the reference discriminant value $V_{1C}$ is corrected at a larger correction degree, to thereby determine the reference discriminant value $V_{1C}$ which is adequate for improving the responsiveness of the air-fuel ratio control to the outputs of the rear $O_2$ sensor 18.

The deviation-correction value curve shown in FIG. 7 is set beforehand, with the characteristics of the front and rear $O_2$ sensors 17 and 18 taken into account, so that the reference discriminant value $V_{1C}$ may be corrected by an amount required for eliminating the deviation $\Delta A/F$ of an actual air-fuel ratio from the target air-fuel ratio.

The electronic control unit 40 uses the correction value $f(\Delta V_R)$ set as described above and a constant value $V_o$ (e.g., 0.5V) to subject the reference discriminant value $V_{1C}$ to the feedback correction according to the following formula (B2) (step S46):

$$V_{1C}=V_o+f(\Delta V_R) \quad \text{(B2)}$$

Thus, when the internal-combustion engine E is being driven in the operation region suited to the discriminant value correction, the output reference value $V_{1C}$ of the front $O_2$ sensor 17 is subjected to the feedback correction in accordance with the output value $V_{02R}$ of the rear $O_2$ sensor 18.

On the other hand, if the judgment result in the step S43 is negative, then the program proceeds to a step S44 wherein the electronic control unit 40 sets the reference discriminant value $V_{1C}$ to the aforementioned constant value $V_o$, and terminates the routine.

Calculation of the valve opening duration $T_{INJ}$ and driving of the fuel injection valves The routine for driving the fuel injection valves 8 shown in FIG. 11 is interrupt-executed when the crank pulse is generated for every 180°. When the routine is interrupt-executed, the electronic control unit 40 first determines whether the value of the flag $F_{FC}$ is the value "1," that is, whether the engine E is being driven in the predetermined fuel cut operation region (step S70). If the engine E is being driven in the fuel cut operation region, then no fuel is supplied to the engine E. Therefore, the electronic control unit 40 terminates the routine without carrying out any substantial processing.

If the value of the flag $F_{FC}$ is not the value "1," then the program proceeds to a step S71 wherein the electronic control unit 40 calculates the intake air amount (A/N) per admission stroke. The intake air amount (A/N), which corresponds to the amount of the air supplied to the engine E during the period from the moment the previous crank pulse was generated to the moment the present crank pulse was generated, is calculated according to the engine speed Ne and the air flow per unit time based on the Karman's vortex street signal which is detected by the air flow sensor 11. The electronic control unit 40 then multiplies the intake air amount (A/N), which has been computed in the step S71, by a constant to determine a basic valve opening duration $T_B$ (step S72). Then, the valve opening duration $T_{INJ}$ is calculated according to the following formula (1) (step S73):

$$T_{INJ}=T_B\times K_{AF}\times K+T_D \quad (1)$$

where K is a product value ($K=K_{WT}\cdot K_{AT}\ldots$) of the correction factor such as the water temperature correction factor $K_{WT}$ and the intake air temperature correction factor $K_{AT}$ which have been set in the step S19 of the main routine, and $T_D$ is a dead time correction value set in accordance with the battery voltage or the like.

Next, the electronic control unit 40 sets the thus computed valve opening duration $T_{INJ}$ in the injection timer **40*d*, and triggers the timer (step S74). This causes the associated fuel injection valve 8** to open for a period corresponding to the valve opening duration $T_{INJ}$, so that an amount of fuel corresponding to the valve opening duration $T_{INJ}$ is injected and supplied to the corresponding cylinder.

Figure 12:
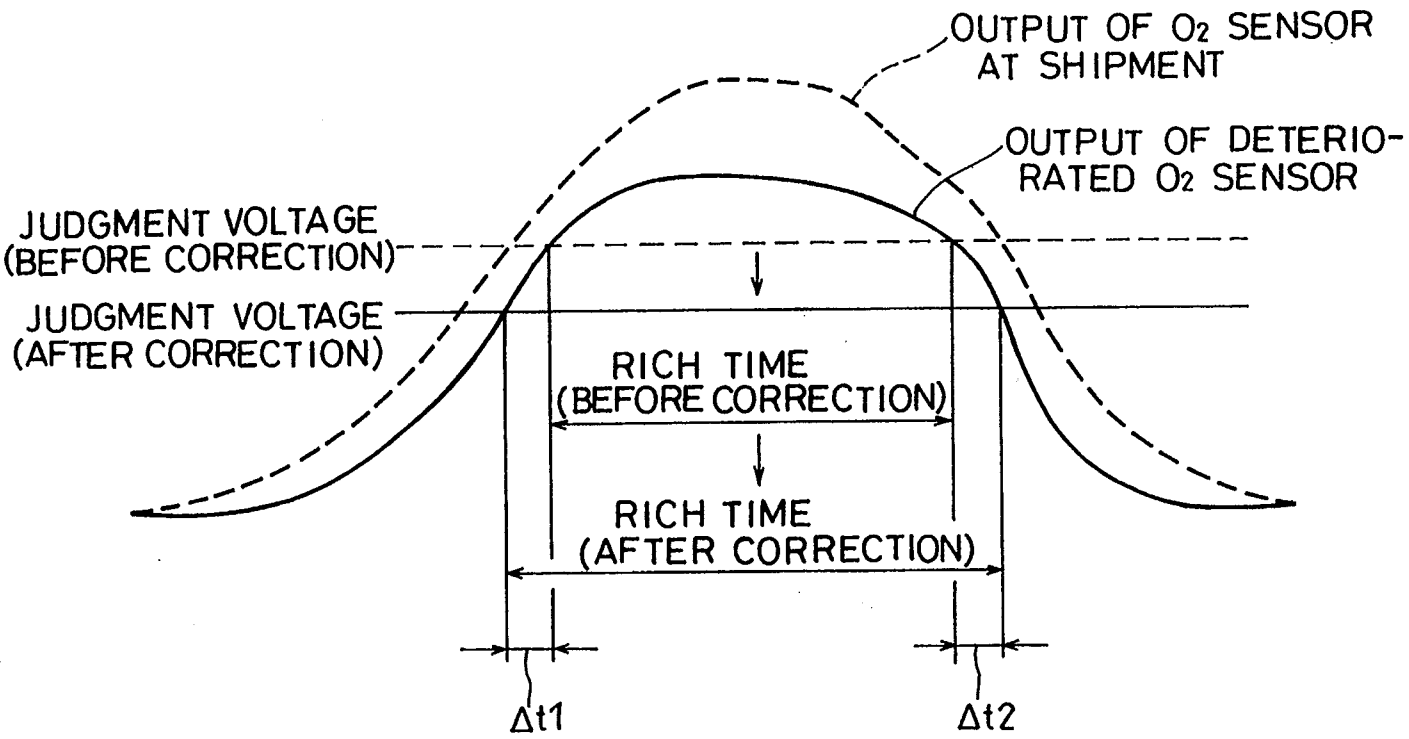
FIG. 12 is a graph showing a change of a rich time observed when a reference discriminant value $V_{1C}$ is corrected by the air-fuel ratio controller shown in FIGS. 1 and 2.

FIG. 12 illustrates that the air-fuel ratio will be properly corrected by the feedback correction of the reference discriminant value $V_{1C}$ performed by the controller for an embodiment of the present invention even if the front $O_2$ sensor 17 has deteriorated. The dotted curve in FIG. 12 indicates the output of an undeteriorated front $O_2$ sensor 17 immediately after shipment, while the solid curve indicates the output of a deteriorated front $O_2$ sensor 17. It can be seen that correcting the reference discriminant value (voltage value) $V_{1C}$ according to the output signal value of the rear $O_2$ sensor 18 corrects the discriminant voltage $V_{1C}$ such that the drop in the sensor output voltage, which is caused when the deteriorated front $O_2$ sensor 17 is used, is compensated. As a result, the problem, in which a time period for making the air-fuel ratio rich is shortened by the periods Δt1 and Δt2 shown in FIG. 12, is solved, whereby a proper time for making the air-fuel ratio rich can be attained even if the use of the deteriorated front $O_2$ sensor 17 is continued.

Figure 13:
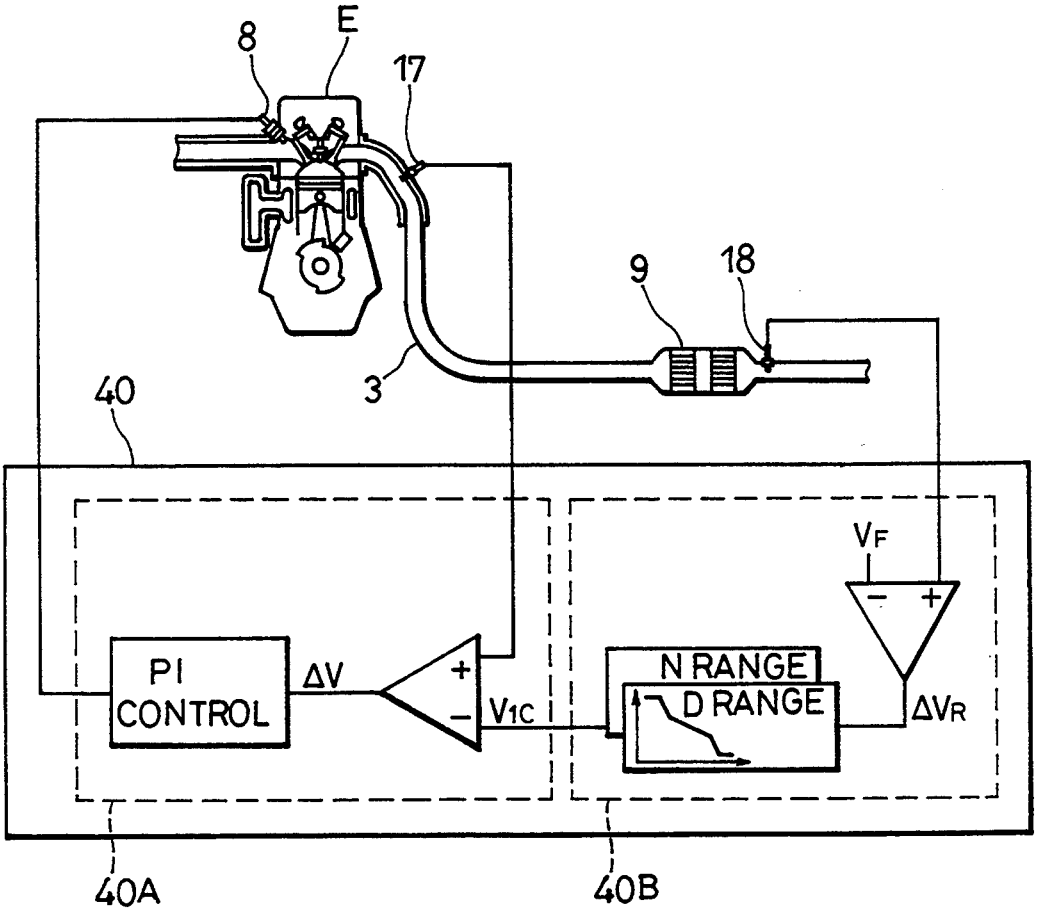
FIG. 13 is a functional block diagram showing a basic configuration of the air-fuel ratio controller shown in FIGS. 1 and 2.

FIG. 13 shows the basic configuration of the air-fuel ratio controller described above. The electronic control unit (ECU) 40 incorporates elements that correspond to an air-fuel ratio controlling unit 40A and a parameter value correcting unit 40B.

The air-fuel ratio controller shown in FIG. 13 which is applicable to an Internal-combustion engine E of a type provided with an automatic transmission, is so designed as to set the correction value $f(\Delta V_R)$ in accordance with the deviation $\Delta V_R$ between the rear $O_2$ sensor 18 and the reference discriminant value and in accordance with a deviation-correction value curve (not shown) which varies depending on whether the current speed change range is in a drive range D or a neutral range N.

The present invention is not limited to the aforesaid embodiment, and may be modified in various manners.

Figure 8:
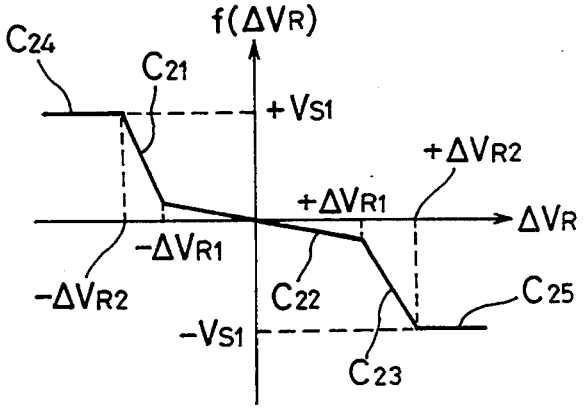
FIG. 8 is a graph showing a deviation a $\Delta V_R$-correction value $f(\Delta V_R)$ curve which is different from the curve shown in FIG. 7.
Figure 9:
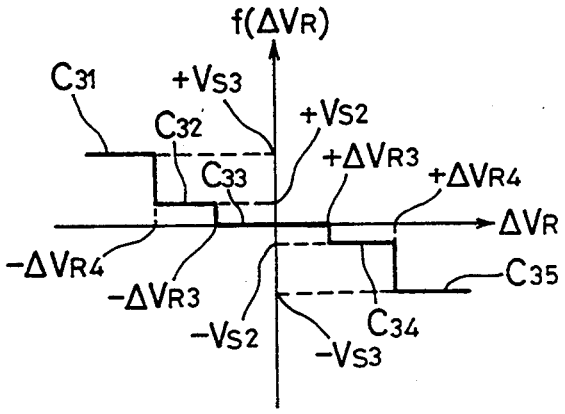
FIG. 9 is a graph showing a deviation a $\Delta V_R$-correction value $f(\Delta V_R)$ curve which is different from the curves shown in FIGS. 7 and 8.

For instance, in the foregoing embodiment, the correction value $f(\Delta V_R)$ used for correcting the reference discriminant value $V_{1C}$ is set in accordance with the deviation-correction value curve shown in FIG. 7, but the correction value may alternatively be set using other deviation-correction value curve, e.g., the one shown in FIG. 8 or FIG. 9. In setting the curves of FIGS. 8 and 9, the characteristics of the front and rear $O_2$ sensors 17 and 18 are considered just like the case with the setting of the curve of FIG. 7.

The deviation-correction value curve of FIG. 8 consists of first through third straight lines $C_{21}$–$C_{23}$ respectively corresponding to the first through third straight lines $C_{11}$–$C_{13}$ shown in FIG. 7, and fourth and fifth straight lines $C_{24}$ and $C_{25}$ respectively extending in parallel to the horizontal axis. According to the setting of the correction value based on this curve, when the magnitude (absolute value) of the deviation $\Delta V_R$ between the smoothed value $V_{F(n)}$ of the rear $O_2$ sensor 18 output $V_{02R}$ and the first reference value $V_F$ is greater than a predetermined magnitude $\Delta V_{Rd}$, the correction value $f(\Delta V_R)$ is clipped by a corresponding one of the value $+V_{s1}$ and $-V_{s1}$, so that the reference discriminant value $V_{1C}$, serving as the aforementioned parameter value, is corrected by the limited correction amount when the magnitude of the deviation $\Delta V_R$ is large.

Further, the deviation-correction value curve shown in FIG. 9 consists of a first straight line $C_{31}$ which causes the correction value $f(\Delta V_R)$ to take the value $+V_{S3}$ in a region where the deviation $\Delta V_R$ is smaller than the value $-\Delta V_{R4}$, a second straight line $C_{32}$ which causes the correction value to take the value $+V_{s2}$ in a region where the deviation is equal to or greater than the value $-\Delta V_{R4}$ and is equal to or smaller than the value $-\Delta V_{R3}$, a third straight line $C_{33}$ which causes the correction value "f" to take the value "0" in a region where the deviation is equal to or greater than the value $-\Delta V_{R3}$ and is equal to or less than the value $+\Delta V_{R3}$, a fourth straight line $C_{34}$ which causes the correction value to take the value $-V_{S2}$ in a region where the deviation is greater than the value $+\Delta V_{R3}$ and is equal to or less than the value $+\Delta V_{R4}$, and a fifth straight line $C_{35}$ which causes the correction value to take the value $-V_{S3}$ in a region where the deviation is greater than the value $+\Delta V_{R4}$.

According to the setting of the correction values based on the deviation-correction value curve of FIG. 9, when the deviation $\Delta V_R$ is within the minute range (dead region) of $\pm\Delta V_{R3}$, the correction value $f(\Delta V_R)$ is set to the value "0," so that no substantial correction of the reference discriminant value $V_{1C}$, serving as the parameter value, is carried out. Furthermore, when the deviation $\Delta V_R$ is in a range of $-\Delta V_{R3}$ through $-\Delta V_{R4}$ or a range of $+\Delta V_{R3}$ through $+\Delta V_{R4}$, the correction value $f(\Delta V_R)$ is set to a constant value $\pm\Delta V_{S2}$, whereby the reference discriminant value $V_{1C}$ is corrected at a relatively small correction degree. Still further, when the absolute value of the deviation $\Delta V_R$ is greater than $\Delta V_{R4}$, the correction value $f(\Delta V_R 1)$ is set to a constant value $\pm\Delta V_{S3}$ whose magnitude is greater than that of the value $\pm\Delta V_{S2}$, so that the reference discriminant value $V_{1C}$ is corrected at a relatively large correction degree.

In the above embodiment, the description was given to a case where the output discriminant value $V_{1C}$ related to the front $O_2$ sensor 17 is subjected to the feedback correction based on the output value of the rear $O_2$ sensor 18, but the parameter (more specifically, the air-fuel ratio control parameter) to be corrected by the output value of the rear $O_2$ sensor is not limited to the output discriminant value $V_{1C}$. More specifically, a proportional correction value P, which is set in relation to the output value of the front $O_2$ sensor 17 crossing a discriminant value, an integral correction value I which gradually varies as time elapses according to the magnitude relationship between the front $O_2$ sensor 17 output and a discriminant value, or a delay time which is set for changing the proportional correction value or switching the increasing/decreasing direction of the integral correction value at a time point delayed from the moment the output of the front $O_2$ sensor 18 crossed the discriminant value may be used as the aforementioned parameter, instead of or together with the output discriminant value $V_{1C}$.

In addition, the present invention is applicable to an air-fuel ratio controller designed to correct the aforementioned parameter by using first and second feedback correction values which are obtained from the outputs of the front and rear $O_2$ sensors 17 and 18, respectively.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air-fuel ratio controller for an internal-combustion engine, comprising:

an upstream-side oxygen sensor, installed in an exhaust system of the internal-combustion engine on an upstream side of an exhaust gas purifier, for detecting a first oxygen concentration in exhaust gas;

a downstream-side oxygen sensor, installed in the exhaust system on a downstream side of or inside the exhaust gas purifier, for detecting a second oxygen concentration in exhaust gas;

air-fuel ratio control means for correcting an air-fuel ratio of an air-fuel mixture supplied to the internal-combustion engine in accordance with a result of comparison between the first oxygen concentration value detected by said upstream-side oxygen sensor and a first reference value, to thereby control the air-fuel ratio to a desired value; and parameter value correcting means for correcting a value of a parameter, related to operation of said air-fuel ratio control means, in accordance with a difference between the second oxygen concentration value detected by said downstream-side oxygen sensor and a second reference value, said parameter value correcting means correcting the value of the parameter at a correction degree that changes according to a magnitude of the difference between the detected value of the second oxygen concentration and the second reference value.

2. The air-fuel ratio controller according to claim 1, wherein the parameter is related to the air-fuel ratio correction carried out by said air-fuel ratio control means.

3. The air-fuel ratio controller according to claim 2, wherein the parameter is related to at least one of a correction amount and a correction implementing timing in the air-fuel ratio correction.

4. The air-fuel ratio controller according to claim 1, wherein, when the difference is large, said parameter value correcting means corrects the parameter value at a larger correction degree than that used when the difference is small.

5. The air-fuel ratio controller according to claim 1, wherein said parameter value correcting means corrects the first reference value which serves as the parameter.

6. The air-fuel ratio controller according to claim 1, wherein said air-fuel ratio control means executes integral correction control for the air-fuel ratio control by using a correction factor which includes an integral correction term, and corrects a value of the integral correction term in accordance with the result of the comparison between the first oxygen concentration value and the first reference value, said parameter value correcting means correcting the integral correction term which functions as the parameter.

7. The air-fuel ratio controller according to claim 1, wherein said air-fuel ratio control means executes proportional correction control for the air-fuel ratio control by using a correction factor, which includes a proportional correction term, and corrects a value of the proportional correction term in accordance with the result of the comparison between the first oxygen concentration value and the first reference value, said parameter value correcting means correcting the proportional correction term which serves as the parameter.

8. The air-fuel ratio controller according to claim 1, wherein said air-fuel ratio control means corrects the air-fuel ratio at the moment when a desired delay time has elapsed since the first oxygen concentration value, which is detected by said upstream-side oxygen sensor, crossed the first reference value, said parameter value correcting means correcting the delay time which functions as the parameter.

9. The air-fuel ratio controller according to claim 1, wherein, when a magnitude of the difference is greater than a predetermined magnitude, said parameter value correcting means corrects the parameter value by a limited amount of correction.

10. The air-fuel ratio controller according to claim 1, wherein, when a magnitude of the difference is smaller than a predetermined magnitude, said parameter value correcting means does not effect any substantial correction to the parameter value.

11. The air-fuel ratio controller according to claim 1, wherein, said parameter value correcting means smooths a value of the second oxygen concentration detected by said downstream-side oxygen sensor, and corrects the parameter value in accordance with the difference between the smoothed value obtained and the second reference value.

12. A method for controlling an air-fuel ratio in an internal-combustion engine, comprising the steps of:

(a) detecting a first oxygen concentration in exhaust gas by an upstream-side oxygen sensor, installed in an exhaust system of the internal-combustion engine on an upstream side of an exhaust gas purifier;

(b) detecting a second oxygen concentration in exhaust gas by a downstream-side oxygen sensor, installed in the exhaust system on a downstream side of or inside the exhaust gas purifier;

(c) correcting the air-fuel ratio of an air-fuel mixture supplied to the internal-combustion engine in accordance with a result of comparison between the first oxygen concentration value detected by said upstream-side oxygen sensor and a first reference value, to thereby control the air-fuel ratio to a desired value; and (d) correcting a value of a parameter, related to operation of said step (c), in accordance with a difference between the second oxygen concentration value detected by said downstream-side oxygen sensor and a second reference value, so that the value of the parameter is corrected at a correction degree that changes according to a magnitude of the difference between the detected value of the second oxygen concentration and the second reference value.

13. The method for controlling an air-fuel ratio according to claim 12, wherein the parameter is related to the air-fuel ratio correction carried out at said step (c).

14. The method for controlling an air-fuel ratio according to claim 13, wherein the parameter is related to at least one of a correction amount and a correction implementing timing in the airfuel ratio correction.

15. The method for controlling an air-fuel ratio according to claim 12, wherein, when the difference is large, the parameter value is corrected at said step (d) at a larger correction degree than that used when the difference is small.

16. The method for controlling an air-fuel ratio according to claim 12, wherein the first reference value which serves as the parameter is corrected at said step (d).

17. The method for controlling an air-fuel ratio according to claim 12, wherein integral correction control is executed at said step (c) for the air-fuel ratio control by using a correction factor which includes an integral correction term, a value of the integral correction term is corrected at said step (c) in accordance with the result of the comparison between the first oxygen concentration value and the first reference value, and the integral correction term which functions as the parameter is corrected at said step (d).

18. The method for controlling an air-fuel ratio according to claim 12, wherein proportional correction control is executed at said step (c) for the air-fuel ratio control by using a correction factor, which includes a proportional correction term, a value of the proportional correction term is corrected at said step (c) in accordance with the result of the comparison between the first oxygen concentration a value and the first reference value, and the proportional correction term which serves as the parameter is corrected at said step (d).

19. The method for controlling an air-fuel ratio according to claim 12, wherein the air-fuel ratio is corrected at said step (c) at the moment when a desired delay time has elapsed since the first oxygen concentration value, which is detected by said upstream-side oxygen sensor, crossed the first reference value, and the delay time which functions as the parameter is corrected at said step (d).

20. The method for controlling an air-fuel ratio according to claim 12, wherein, when a magnitude of the difference is greater than a predetermined magnitude, the parameter value is corrected at said step (d) by a limited amount of correction.

21. The method for controlling an air-fuel ratio according to claim 12, wherein, when a magnitude of the difference is smaller than a predetermined magnitude, substantial correction to the parameter value fails to be affected at said step (d).

22. The method for controlling an air-fuel ratio according to claim 12, wherein a value of the second oxygen concentration detected by said downstream-side oxygen sensor is smoothed at said step (3), and the parameter value is corrected at said step (d) in accordance with the difference between the smoothed value obtained and the second reference value.

* * * * *